US007240495B2

(12) United States Patent
Symko et al.

(10) Patent No.: US 7,240,495 B2
(45) **Date of Patent: *Jul. 10, 2007**

(54) HIGH FREQUENCY THERMOACOUSTIC REFRIGERATOR

(75) Inventors: Orest G. Symko, Salt Lake City, UT (US); Ehab Abdel-Rahman, Cairo (EG)

(73) Assignee: University of Utah Research Foundation, Salt Lake City, UT (US)

( * ) Notice: Subject to any disclaimer, the term of this patent is extended or adjusted under 35 U.S.C. 154(b) by 318 days.

This patent is subject to a terminal disclaimer.

(21) Appl. No.: 10/957,076

(22) Filed: Oct. 1, 2004

(65) Prior Publication Data

US 2005/0109042 A1 May 26, 2005

Related U.S. Application Data

(63) Continuation-in-part of application No. 10/458,752, filed on Jun. 10, 2003, now Pat. No. 6,804,967, which is a continuation of application No. 09/898,539, filed on Jul. 2, 2001, now Pat. No. 6,574,968.

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS

| | | | | |
|---|---|---|---|---|
| 4,067,956 | A | | 1/1978 | Franklin et al. |
| 4,124,691 | A | | 11/1978 | Geen et al. |
| 4,398,398 | A | | 8/1983 | Wheatley et al. |
| 4,489,553 | A | | 12/1984 | Wheatley et al. |
| 4,584,840 | A | | 4/1986 | Baumann |
| 4,953,366 | A | | 9/1990 | Swift et al. |
| 5,165,243 | A | * | 11/1992 | Bennett ..... 62/6 |
| 5,266,961 | A | | 11/1993 | Milroy |
| 5,303,555 | A | | 4/1994 | Chrysler et al. |
| 5,339,640 | A | | 8/1994 | Reinke |
| 5,349,363 | A | | 9/1994 | Milroy |
| 5,361,076 | A | | 11/1994 | Milroy |
| 5,369,625 | A | * | 11/1994 | Gabrielson ..... 367/140 |
| 5,412,394 | A | | 5/1995 | Milroy |
| 5,456,082 | A | | 10/1995 | Keolian et al. |
| 5,469,165 | A | | 11/1995 | Milroy |
| 5,483,248 | A | | 1/1996 | Milroy |

(Continued)

FOREIGN PATENT DOCUMENTS

WO WO 03/004946 A1 1/2003

OTHER PUBLICATIONS

"Reticulated Vitreous Carbon: A New Form of Carbon." ERG: Materials and Aerospace Corporation, Oakland, CA.

*Primary Examiner*—William C. Doerrler
(74) *Attorney, Agent, or Firm*—Morriss O'Bryant Compagni, P.C.

(57) ABSTRACT

A thermoacoustic refrigerator having a relatively small size which utilizes one or more piezoelectric drivers to generate high frequency sound within a resonator at a frequency of between about 4000 Hz and ultrasonic frequencies. The interaction of the high frequency sound with one or more stacks create a temperature gradient across the stack which is conducted through a pair of heat exchangers located on opposite sides of each stack. The resonator has an asymmetrical, round configuration which enhances the cooling power of the thermoacoustic refrigerator.

34 Claims, 8 Drawing Sheets

U.S. PATENT DOCUMENTS 5,485,165 A 1/1996 Foard
5,561,984 A 10/1996 Godshalk et al.
5,583,524 A 12/1996 Milroy
5,604,505 A 2/1997 Matterer
5,647,216 A 7/1997 Garrett
5,673,561 A * 10/1997 Moss ..... 62/6
5,771,567 A 6/1998 Pierce et al.
5,813,234 A 9/1998 Wighard
5,857,319 A 1/1999 Sattelmayer
5,857,340 A 1/1999 Garrett
5,865,167 A 2/1999 Godik
5,892,293 A * 4/1999 Lucas ..... 290/1 R
5,901,556 A 5/1999 Hofler
5,953,921 A 9/1999 Garrett
5,996,345 A 12/1999 Hofler
6,032,464 A * 3/2000 Swift et al. ..... 60/520
6,164,073 A 12/2000 Swift et al.
6,385,972 B1 5/2002 Fellows
6,574,968 B1 * 6/2003 Symko et al. ..... 62/6
6,804,967 B2 * 10/2004 Symko et al. ..... 62/6

* cited by examiner

HIGH FREQUENCY THERMOACOUSTIC REFRIGERATOR

CROSS-REFERENCE TO RELATED APPLICATIONS

The present application is a continuation-in-part of U.S. patent application Ser. No. 10/458,752 filed on Jun. 10, 2003, now U.S. Pat. No. 6,804,967, which is a continuation of U.S. patent application Ser. No. 09/898,539 filed on Jul. 2, 2001, now U.S. Pat. No. 6,574,968, herein incorporated by this reference.

FUNDING

The present application has been at least partially funded by the Office of Naval Research contract numbers PE 61153 N and N00014-93-1-1126.

BACKGROUND

1. Field of the Invention

The present invention relates generally to thermoacoustic refrigerators and, more specifically, to a thermoacoustic refrigerator having a relatively small size which utilizes one or more piezoelectric drivers to generate high frequency sound within a resonator. The interaction of the high frequency sound with one or more stacks create a temperature difference across the stack which is thermally anchored at each end to a pair of heat exchangers located on opposite sides of the stack.

2. Background of the Invention

The thermoacoustic effect has a long history and it is only recently that new applications have stimulated its development. In the 18th century it was discovered that a glass tube open at one end, would produce sound when the closed end was heated. This device is known as the Soundhaus Tube. Subsequently it was discovered that a tube open at both ends will also produce sound when a metallic mesh located in the lower half of the tube is heated and the tube is held up vertically. In such a device, convection plays an important role. This is known as the Rijke Tube. It was not until the end of the 19th century when Lord Rayleigh explained how it works. The device is essentially an example of a relaxation oscillator where oscillations are sustained when energy is injected at the right phase of the oscillation cycles.

In 1975, Merkli and Thomann observed the converse of the above effect, that an acoustic field can produce cooling in a resonant tube. In 1983, Wheatley et al built the first thermoacoustic refrigerator; it operated at 500 Hz and produced temperature differences of approximately 100° C. Since the discovery by Merkli and Thomann that cooling can be produced by the thermoacoustic effect in a resonance tube, research has concentrated on developing the effect for practical applications. One approach in the art has been to increase the audio pumping rate. While the experiments of Merkli and Thomann used frequencies of around 100 Hz, Wheatley et al. successfully raised the operating frequency to around 500 Hz and achieved impressive cooling rates in their refrigerator. This has encouraged others to build various configurations of thermoacoustic refrigerators.

The essential ingredients of a thermoacoustic refrigerator or heat pump are:

i. A source of sound to pump heat into the device;

ii. A working gas, typically air at 1 atmosphere;

iii. An acoustic resonator for amplifying the level of sound and for providing phasing for the operation of the refrigerator;

iv. A secondary medium comprising a stack along which sound pumps heat, i.e. a thermal rectifier; and v. Two heat exchangers, one at each end of stack providing a hot heat exchanger and a cold heat exchanger.

An important element in the operation of a thermoacoustic refrigerator is the special thermal interaction of the sound field with the stack. There exists a weak thermal interaction characterized by a time constant given by $\omega\tau \approx 1$ where $\omega$ is the audio pump frequency and $\tau$ is the thermal relaxation time for a thin layer of gas to interact thermally with a plate or stack. The amount of gas interacting with the stack is determined approximately by the surface area of the stack and by a thermal penetration depth $\delta_k$ given by:

$$\delta_k = (2\kappa/\omega)^{1/2}$$

Here $\kappa$ represents the thermal diffusivity of the working fluid. By increasing $\omega$, the weak coupling condition is met by a reduction of $\delta_k$ and hence of $\tau$. The work of acoustically pumping heat up a temperature gradient as in a refrigerator is essentially performed by the gas within approximately the penetration depth. The amount of this gas has an important dependence on the frequency of the audio drive. In a high frequency refrigerator, smaller distances and masses are utilized thus making the heat conduction process relatively quick.

Each of the prior art thermoacoustic refrigerators are relatively complicated to manufacture and thus expensive. In addition, thermoacoustic refrigerators known in the art tend to be massive and typically not well suited for use on a very small level such as for use in cooling semiconductors and other small electronic devices or biological samples. Thus, it would be advantageous to provide a thermoacoustic refrigerator that can be made relatively small with a fast response time while retaining good cooling abilities. In addition, it would be advantageous to provide a thermoacoustic refrigerator that operates relatively efficiently and that is relatively simple and economical to manufacture.

SUMMARY OF THE INVENTION

In accordance with the principles of the present invention, a high frequency thermoacoustic refrigerator is provided. A thermoacoustic refrigerator according to the present invention is configured for high frequency operation, ranging from about 4 kHz to the ultrasonic range. In addition, the present invention provides a thermoacoustic refrigerator that is configured to allow miniaturization to allow compact array grouping in such applications as heat management in electronics, computers, microcircuits, and biological systems.

Utilizing a driver that operates at a high frequency allows the thermoacoustic device of the present invention to be made smaller in size as the wavelength at such a frequency is short. Thus, the present invention provides a compact thermoacoustic refrigerator in which its dimensions scale with the wavelength of the audio drive.

Since simple scaling in size of the standard elements in thermoacoustic refrigerators to the high-frequency range of operation will not maintain sufficient efficiency for the engines to be effective, new elements according to the principles of the present invention make it feasible to have thermoacoustic refrigerators operating at frequencies over one or more orders of magnitude above prior art performance.

In one embodiment, the driver consists of a piezoelectric unit having a bimorph or monomorph configuration. This type of electrostatic device outperforms electromagnetic drivers used in prior art in size, weight and efficiency. As the size of the driver is reduced in size, its electrostatic power density scales as 1/x where x is a characteristic device length. For an electromagnetic driver, power density scales as x making it not as practical for small scale applications. Size considerations also favor piezoelectric drivers which are essentially thin films on a substrate. Being non-magnetic, such drivers can be used in many applications where magnetic interference produced by an electromagnetic driver may not be accepted. While seeking maximum efficiency in the electric-to-sound conversion process, driver heat production is maintained at a relatively low level since the driver is essentially a capacitor with some dissipation. An electromagnetic driver, on the other hand, has a typical voice coil resistance of 8 ohms and produces significant heat.

The stack of the present invention consists of fibrous material in a random arrangement. The stack length x is a fraction (typically 10%) of the sound wavelength. The stack is capable of maintaining a temperature difference created by the acoustic pumping action while minimizing heat conduction losses along its length. Thus, the stack is comprised of materials in fiber form having low thermal conductivity. Such materials may include cotton or glass wool with fibers 10 μm (10 microns) or less in diameter.

At a filling factor of 1–2% the stack provides enough surface area for optimum acoustic heat pumping and yet it offers very low resistance to the acoustic field. Low flow resistance is important for maintaining a high quality factor Q of the resonator. Thermally, a fine fiber structure provides a quasi-continuous path for acoustic heat pumping and low heat conduction loss between the hot and cold heat exchangers, especially when the fibers are randomly packed with effective continuous paths longer than the stack length x. It is possible to use fibers much thinner than 10 μm diameter to further reduce heat losses and flow resistance. The performance of the fibrous stack in very small scale applications is superior to the parallel plates stack or the porous material stack. The latter offering a multiplicity of air pockets which provides a large surface area but which does not provide a continuous sound path, causing extra resistance to the sound field and a corresponding reduction in the quality factor Q of the resonator. Moreover, fibrous materials are typically flexible to provide relatively good thermal contact against the heat exchangers. A random distribution of fibers in the stack leads to a flow resistance which is substantially smaller than a layered distribution of such fibers.

A resonator according to the present invention has a relatively high quality factor Q which raises the sound level produced by the driver. That is, the sound pressure level in the resonator is proportional to the quality factor Q which relates directly to refrigerator performance. The quality factor is raised by operating at high frequency and by keeping the resonator diameter relatively large. In addition, by providing a stack with a relatively large effective surface area, maximum cooling power is produced. Thus, the miniaturization of the refrigerator results in a relatively short unit with a relatively large diameter.

There are two coupling methods for interfacing the driver to the resonator: (i) internal coupling where the driver forms one end of the resonator cavity; (ii) external coupling where the driver is attached to the outside of the resonator essentially shaking it at its resonant frequency. In the first method, Q values of 40–50 can be attained at 5 kHz. Utilizing the second method, however, produces Q values of 400–500.

At high intensity levels in the resonator, especially with the second method of coupling, it is helpful to avoid the excitation of higher harmonics which would reduce the available acoustic power input from the driver. By using a resonator in accordance with the principles of the present invention which does not sustain many harmonic modes, the acoustic power from the driver is maximized.

In one embodiment, the resonator is comprised of an asymmetric elliptical resonator defining a similarly configured internal cavity. The resonator is excited acoustically at one end, such as the larger end, by attaching the cone of the driver directly to an external surface of the resonator. By attaching the driver to the outside of the resonator, heat produced by the driver is radiated to the outside instead of being transferred to the resonator.

By attaching the driver to the outside of the resonator, the resonator geometry is not necessarily tied to the size or shape of the driver, allowing for more efficient and acoustically precise designs. Such geometry and coupling method, provides more efficient design features.

In another embodiment, the resonator is generally spherical in geometry. A standing wave produced within such resonator will be radially disposed within the resonator. As such, the stack is in the form of a portion of a spherical shell or segmented shell. Large Q values for the resonator can be maintained by operating at a higher resonance modes above the fundamental mode while keeping the resonator dimensions fixed. As such, multiple stack arrangements can be accommodated.

In other embodiments of the present invention, the resonator has various symmetrical and asymmetrical configurations that can be accommodated by coupling the driver to the exterior of the resonator. It is particularly beneficial, however, to provide a resonator that has an asymmetrical shape when viewed in cross-section along a longitudinal axis of the resonator. Such a shape provides a standing wave for the first acoustic harmonic across the stack of the thermoacoustic refrigerator while decreasing the magnitudes of other harmonics for a given driver frequency. Because, such other harmonics, other than the primary harmonic, can effectively decrease the magnitude of the standing wave produced by the primary harmonic, decreasing the magnitudes of the other harmonics has the effect of increasing the cooling efficiency of the thermoacoustic refrigerator.

In addition, by coupling the driver to the outside of the resonator, the resonator can more easily be adapted to utilize mediums other than air at ambient pressure as the working fluid. That is, it may be desirable to create a sealed resonator that is filled with a desired medium at a desired pressure in order to increase the cooling performance of the thermoacoustic refrigerator. By eliminating the need to incorporate the driver into the resonator structure, the resonator can be designed as a completely enclosed structure of any desired configuration.

By incorporating the principles of the present invention into a miniature thermoacoustic refrigerator, the thermoacoustic refrigerator can produce a relatively large temperature difference across the stack to attain correspondingly relatively low refrigeration temperatures.

The present invention also provides a thermoacoustic refrigerator that utilizes large temperature oscillations with small displacements along the stack leading to a large critical temperature gradient across the stack in a thermoacoustic refrigeration.

The present invention further provides a thermoacoustic refrigerator that can operate in the ultrasonic range.

The present invention also provides a thermoacoustic refrigerator that is simple and inexpensive to manufacture and is relatively compact.

The present invention also provides a thermoacoustic refrigerator that is well-suited for employing a working gas high pressure operation.

The present invention further provides a thermoacoustic refrigerator that can be easily adapted for miniaturization.

The present invention also provides a thermoacoustic refrigerator that has a quick response and fast equilibration rate for electronic device heat management.

The present invention further provides a thermoacoustic refrigerator that utilizes a convenient frequency range for a piezoelectric driver since such drivers are relatively light, small, efficient, and inexpensive.

The present invention also provides a thermoacoustic refrigerator in which some components, such as heat exchangers and stack, can be fabricated using photolithography, MEMS, and other film technologies.

The present invention also provides a thermoacoustic refrigerator in which the power density of the device can be raised by increasing the frequency and thus reducing its size.

The present invention further provides a thermoacoustic refrigerator that is useful for many applications that require small compact refrigerators, for example to provide a relatively simple, compact, and inexpensive device that can be used for contact cooling small electronic components and small biological systems.

The thermoacoustic refrigerator is comprised of a resonator that also functions as a housing for an acoustic driver, a stack and a pair of heat exchangers positioned on opposite sides of the stack. The driver is a piezoelectric or other similar device that can operate at high frequencies of at least 4,000 Hz. The stack may be formed from random fibers that are comprised of a material having poor thermal conductivity, such as cotton wool or glass wool, that provide a relatively large surface area. The heat exchangers are preferably comprised of a material having good thermal conductivity such as copper. Finally, the resonator contains a working fluid, such as air or other gases at 1 atmosphere or higher pressures.

A compact thermoacoustic refrigerator in accordance with the principles of the present invention includes a resonator defining a generally spherical or irregular elliptical chamber that is generally completely enclosed. The length of the resonator is approximately equal to ½ the wavelength of sound in the working fluid produced by the driver.

In another embodiment of the present invention, a thermoacoustic refrigerator is comprised of a rectangular—or trapezoid-shaped resonator. A driver is coupled to the outside of the resonator to cause a standing wave to be formed within the resonator.

In any of the embodiments of the present invention, the thermoacoustic refrigerator may be comprised of a resonator having any desired shape with one or more drivers coupled to the outside surface of the resonator to cause one or more standing waves to be formed within the resonator. In addition, one or more stacks with associated heat exchangers may be provided within the resonator.

In another embodiment of the present invention, a method of cooling utilizing thermoacoustic technology comprises providing a sealed chamber defining a resonator with first and second heat exchangers disposed therein and a random fiber stack thermally coupled to the heat exchangers. High frequency sound is generated on the outside of the sealed chamber which causes a standing wave within the chamber. A corresponding heat flow from the cold end of the stack to the hot end cooling the cold side heat exchanger and depositing the heat at the hot heat exchanger. By utilizing a chamber having a configuration that limits propagation of standing waves for higher harmonics, the amplitude of the primary standing wave generated by the driver is maximized to produce the greatest cooling effect for a given frequency.

Since the optimum position of the stack within the chamber resulting in the optimal temperature difference across the stack is a function of the length of the stack in association with the frequency and the wavelength of the sound wave, it may be desirable to allow adjustment of the length of the resonator or adjustment of the position of the stack/heat exchanger unit at the optimal position in the resonator to "tune" the resonator or stack/heat exchanger, as the case may be, for maximum efficiency. Thus, the method of cooling further includes adjusting the position of the stack and heat exchangers within the resonator to maximize the temperature difference between the first and second heat exchangers for a given driver.

Other advantages of the present invention will become apparent upon reading the following detailed description and appended claims, and upon reference to the accompanying drawings.

DETAILED DESCRIPTION OF THE ILLUSTRATED EMBODIMENTS

Reference is now made to the drawings wherein like parts are designated with like numerals throughout. It should be noted that the present invention is discussed in terms of a thermoacoustic refrigerator operating at a frequency of approximately 4,000 Hz or more. After understanding the present invention, however, those skilled in the art will appreciate that the frequency and size of components used therewith can be readily miniaturized in accordance with the teachings provided herein.

Figure 1:
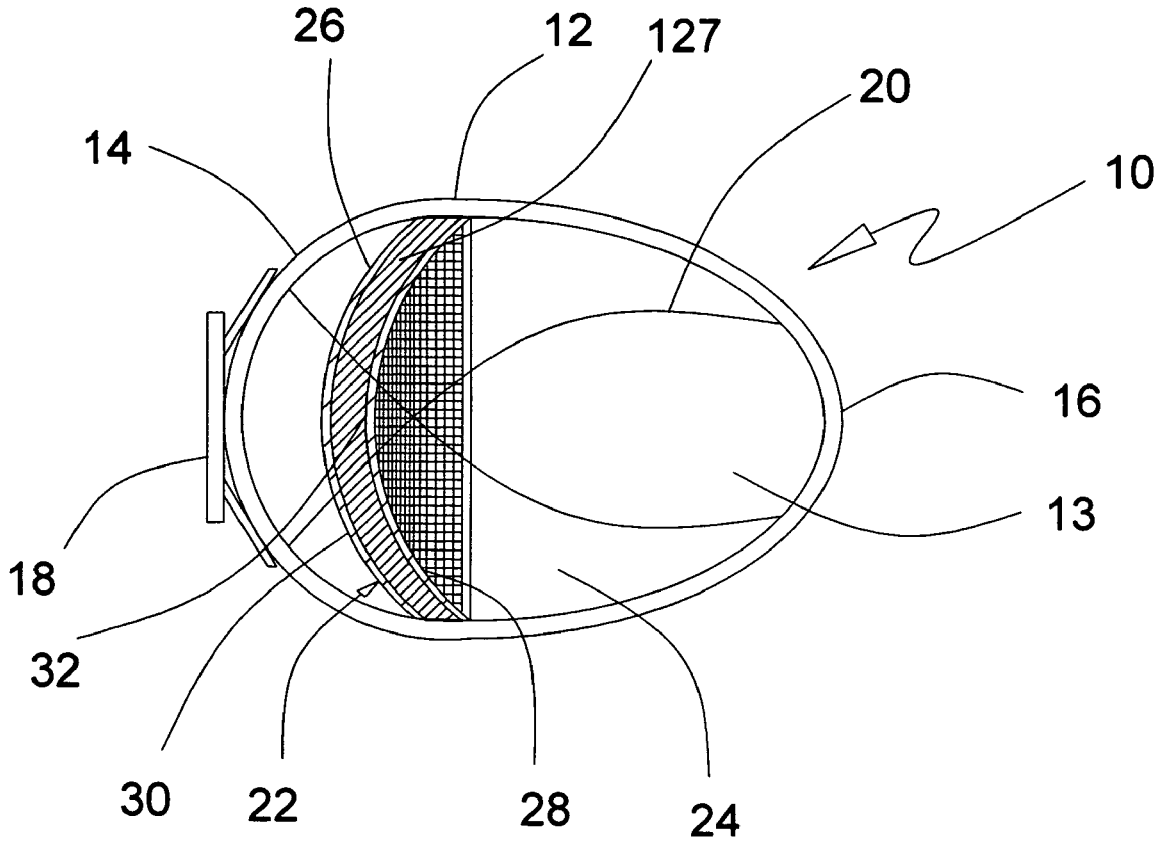
FIG. 1 is a cross-sectional side view of a first embodiment of a thermoacoustic refrigerator in accordance with the principles of the present invention.

Referring now to FIG. 1, a compact thermoacoustic refrigerator, generally indicated at 10, is illustrated. The thermoacoustic refrigerator 10 is comprised of a resonator 12 forming an enclosure for housing some of the components of the thermoacoustic refrigerator 10. The resonator 12 is an enclosed structure having an elliptical, ovoid or "egg" shape defining an interior chamber 13 of a similar asymmetrical shape when viewed in cross-section along a longitudinal length of the resonator 12 as shown in FIG. 1. This non-cylindrical, round shaped resonator 12 amplifies the sound level thus leading to increased cooling power of the thermoacoustic refrigerator. As will be described with reference to other embodiments herein, other geometries are also contemplated. Such geometries may be categorized into two general categories, either 1) a non-cylindrical round shape, such as a sphere, ovoid, elliptical shape, or other round shapes whether asymmetrical or symmetrical or 2) asymmetrical shapes that may not necessarily have rounded sides, such as trapezoidally-shaped, conically-shaped, frustoconically-shaped or any other asymmetrical shape when such shape is divided along a central axis (either longitudinal or transverse).

Coupled to the outside of the resonator 12 proximate a first end 14 is a driver 18. The driver 18 is capable of generating high frequency sound. In addition, the length of the resonator is configured such that approximately a half wavelength standing wave 20 is produced by the driver 18 within the chamber 13. The standing wave 20 is radial and the stack is in the form of a spherical shell or a segmented shell. Large Q values for the resonator 12 can be maintained by operating at a higher resonance mode above the fundamental or primary mode, while keeping the resonator dimensions fixed. This allows for multiple stack arrangements depending upon the particular resonance mode. Positioned between the first end and a second end 16 is a stack 22. The stack 22, as will be described in more detail, has a density that is inversely proportionate to the thermal penetration depth of a working fluid 24 contained within the resonator 12. The stack 22 is essentially "sandwiched" between a pair of heat exchangers 26 and 28. That is, the exchangers 26 and 28 are adjacent to and abut the ends 30 and 32, respectively, of the stack 22. Preferably, the heat exchanger 26 comprises the hot exchanger as it is closest to the driver 18 which will typically produce an amount of heat itself. The heat exchanger 28 is thus the cold exchanger. Positioning the stack 22 and heat exchangers 26 and 28 at a different point within the resonator, however, could result in the heat exchanger 26 being the cold exchanger.

The asymmetrical shape of the resonator 12 allows a first harmonic resonance of the driver/resonator to produce the standing wave 20 within the chamber 13. Thus, the shape of the chamber 13 when subjected to a particular frequency from the driver allows the first harmonic resonance to be the primary generator of the standing wave 20 while decreasing the magnitudes of other harmonics for a given driver frequency. Because, such other harmonics, other than the primary harmonic, can effectively decrease the magnitude of the standing wave produced by the primary harmonic, decreasing the magnitudes of the other harmonics has the effect of increasing the cooling efficiency of the thermoacoustic refrigerator. As such, for a given driver and a given resonator size, providing a resonator of an asymmetrical shape significantly increases the cooling power of the thermoacoustic refrigerator in accordance with the principles of the present invention.

In order to produce a device that is relatively simple and inexpensive to manufacture, the working fluid is preferably air at 1 atmosphere. It is contemplated, however, that other gases and combinations of gases at higher pressures may be utilized to increase the efficiency of cooling across the stack 22. In addition, because it is desirable to operate the thermoacoustic refrigerator at higher frequencies in order to decrease its size, the driver 18 preferably comprises a piezoelectric device. Likewise, the stack 22 is comprised of random fibers 27 preferably in the form of cotton wool, glass wool or other random fiber materials known in the art which will provide high surface area for interaction with sound but low acoustic attenuation. Thus, the stack is essentially a randomly configured, open-celled material having a relatively high surface area.

The components utilized in accordance with the present invention have been chosen for simplicity realizing that they are far from ideal. Those skilled in the art, however, will appreciate that various modifications to and equivalent components to those disclosed herein may increase the efficiency of the thermoacoustic refrigerator without departing from the spirit and scope of the present invention.

Figure 2:
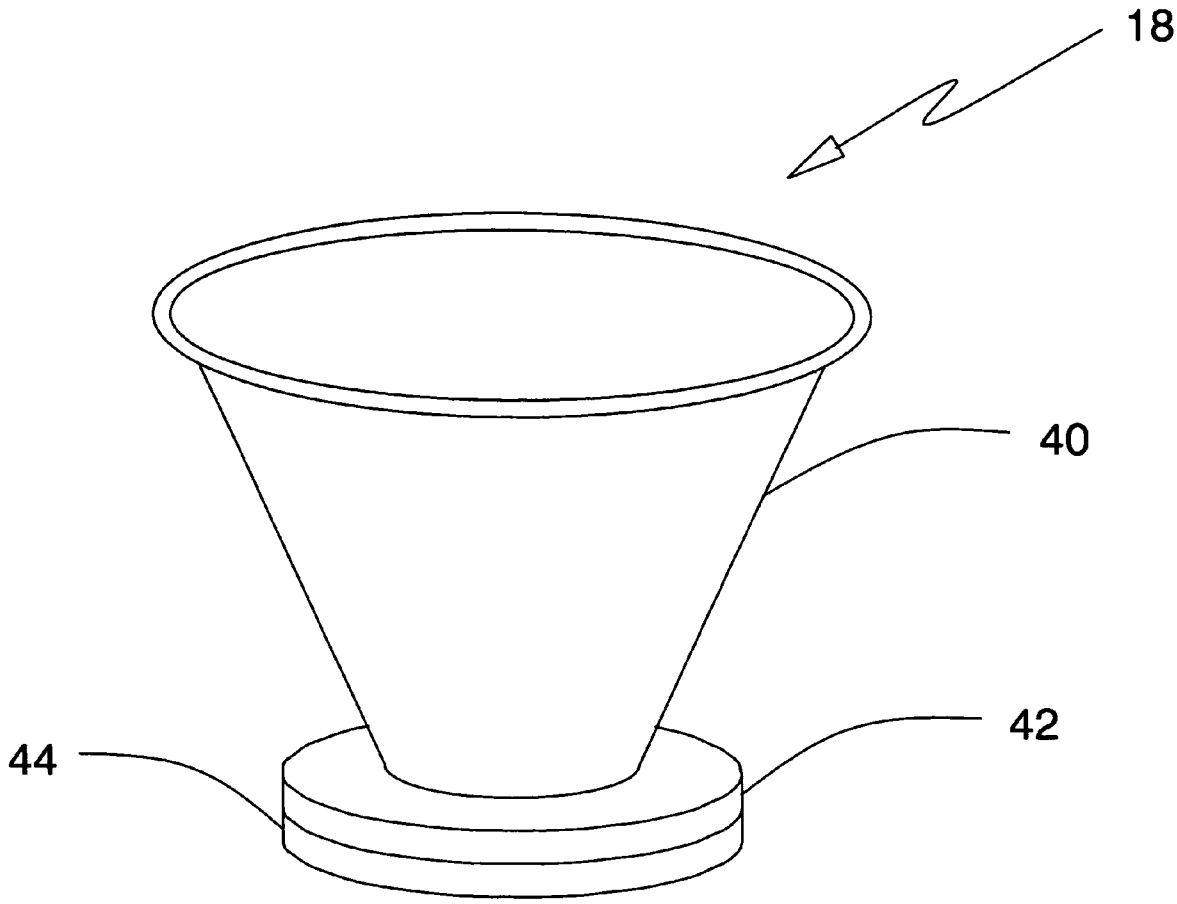
FIG. 2 is a perspective side view of a bimorph piezoelectric driver cone loaded in accordance with the principles of the present invention.

As illustrated in FIG. 2, the acoustic driver 18 is a piezoelectric driver of a bimorph or monomorph type, an example of one being the Motorola KSN 1046, horn-loaded for better impedance matching. This model has a relatively high sensitivity and broad frequency response. Its characteristics include a mass of 1.3 g, a sensitivity ~95 dB/watt/m, which may vary by a few decibels depending on the unit, and a frequency response of 4–27 kHz. In addition, such drivers vary widely in frequency response depending on the particular unit. A horn cone 40 for such a model has a maximum diameter of about 4 cm. The driver efficiency can be as high as 50–90%, depending on the load. Instead of using a cone with the piezo element, it is also possible to match the piezo to its load.

In a bimorph driver 18, two piezoelectric discs 42 and 44 are bonded together on each side of a brass shim (not shown). The piezoelectric discs 42 and 44 change lengths in opposite direction with applied voltage causing a large bending action. When coupled to a cone diaphragm 40, sound waves are transmitted from the cone 40. This device behaves similarly to a bimetallic strip which flexes upon heating.

This type of driver 18 has ideal characteristics for use in a high frequency refrigerator 10. Dissipation power losses are relatively small since a piezoelectric is a capacitor with a dielectric. The model previously described has a capacitance C of 145 nano Farads whose losses come from the hysteresis behavior of the dielectric. Compared to the electromagnetic drivers utilized in the prior art whose voice coils typically have ~8 ohms resistance, the dissipation power is much smaller for the piezoelectric driver 18 than for the regular electromagnetic driver. In addition, the piezoelectric driver 18 is a voltage device while an electromagnetic driver is a current device. Furthermore, the piezoelectric driver 18 is very light and thus useful for such applications as small electronics. Its efficiency is much higher than that of the electromagnetic driver. Piezoelectric drivers can be approximately 50–90 percent efficient, are very light, and dissipate much less heat than electromagnetic drivers. Moreover, piezoelectric drivers are non-magnetic thus not emitting an magnetic field which can have certain utility in various electronic or other applications where electromagnetic fields can effect the performance of the circuitry, electronic device or system.

Figure 3:
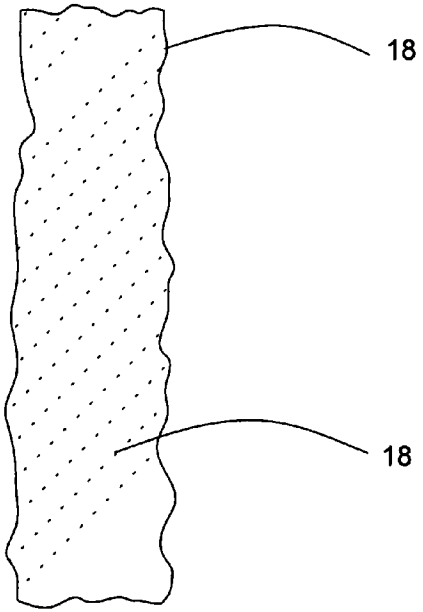
FIG. 3, is a cross-sectional side view of a stack formed from random fibers in accordance with the principles of the present invention.

Referring now to FIG. 3, a cross-sectional view of the stack 27 is illustrated. Because of the relatively small size of the stack 27 of the present invention (having a thickness of Δx 4 mm or less), a conventional stack consisting of parallel plates of Mylar would not be easy to assemble. It would be difficult to maintain small uniform spacing and difficult to make good thermal contact with the heat exchangers 26 and 28 at each end of the stack 27. As such, the present invention utilizes a random fiber material, such as cotton wool 50, to form the stack 27. The cotton wool 50 is pressed to the desired thickness, e.g., 0.4 cm. Cotton wool 50 may have a density of approximately 0.08 g/cm$^3$, a thermal conductivity of 0.04 W/m ° C. for each fiber, and an average fiber diameter of 10 μm. As such, cotton wool provides an enormous surface area to better accommodate the transfer of heat from the working fluid 24 (see FIG. 1) to the fibers and is thus quite efficient. Indeed, the number of fibers in a stack 3 cm in diameter is approximately $10^5$. Furthermore, a typical effective total perimeter of the fibers of such a stack is approximately 3 m with an effective cross-sectional area for heat pumping of $7\times10^{-4}$ m$^2$ and a total active area of stack exposed to sound field of over 150 cm$^2$.

Figure 4:
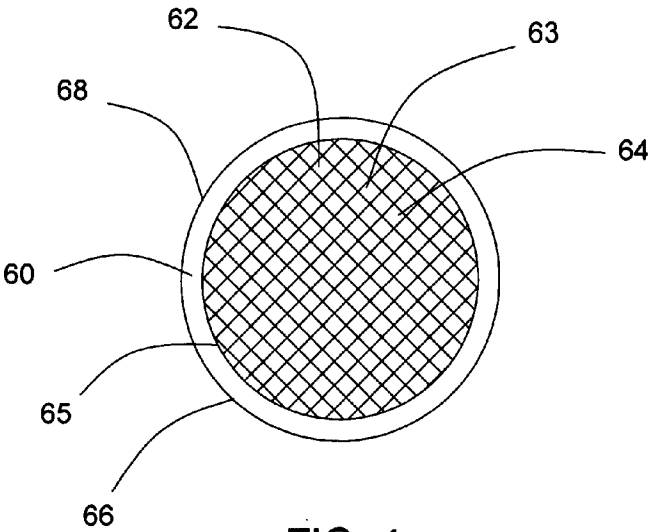
FIG. 4 is a schematic top view of a first embodiment of a heat exchanger in accordance with the principles of the present invention.
Figure 5:
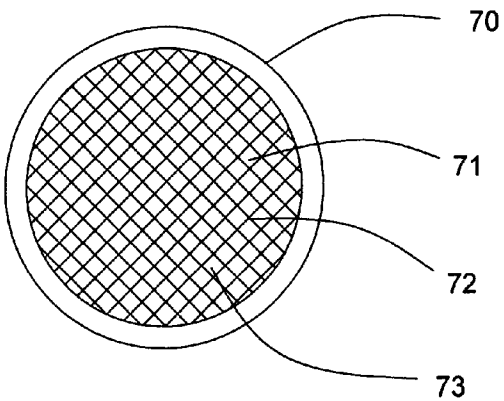
FIG. 5 is a schematic top view of a second embodiment of a heat exchanger in accordance with the principles of the present invention.

FIGS. 4 and 5 illustrate heat exchangers 60 and 70, respectively, in accordance with the present invention. FIG. 4 shows a heat exchanger fabricated using photolithography to form the heat exchanger 60 from a copper sheet. The heat exchanger 60 has square holes, such as holes 62, 63, and 64, having a dimension of 0.5 mm×0.5 mm for the size of the driver 18 previously mentioned with solid spacers, such as spacers 65 and 66 having dimensions of 0.8 mm×0.8 mm. Such an exchanger 60 provides a sound transparency of about 25%. For application with a 4 cm driver cone 40 the diameter will preferably be about 3.4 cm and have a thickness of about 0.3 mm. The heat exchanger 60 has an outer ring 68 for contacting the resonator 12 and transferring heat thereto.

FIG. 5 shows another preferred embodiment of a heat exchanger 70 in accordance with the present invention. The heat exchanger 70 may be formed from a copper screen, flattened by a press, with square holes, such as holes 71, 72 and 73 having dimensions of, for example, 0.8 mm×0.8 mm and a wire to wire distance of 1.2 mm for adjacent wires. For such a heat exchanger, the sound transparency is approximately 44%. When such a heat exchanger 70 is utilized as the hot heat exchanger 26, to improve heat transfer at the hot heat exchanger (since it handles more heat than the cold one), the heat exchanger 70 may be thermally anchored to a large (e.g., 0.5 cm thick) copper heat exchanger or heat sink (not shown). Although thin, the heat exchangers 60 and 70 maintain heat flows of approximately 2 watts without creating a substantial ΔT across the heat exchanger (ΔT is less than 0.1° C.).

The working fluid may simply be comprised of air at one atmosphere in accordance with the present invention. The use of air provides a simple means of manufacture in that more complex pressurization and assembly techniques are not required. The properties of air include a thermal conductivity of 0.26 mW/cm/° C., a density at 1 atmosphere and 20° C. of 0.00121 g/cm$^3$, a viscosity at 20° C. of 18.1 μpoise (18.1 micropoise), the speed of sound at 20° C. equal to 344 m/sec, thermal penetration depth at 5 kHz of 0.05 mm, viscous penetration depth at 5 kHz of 0.035 mm and a Prandtl number of 0.707. Because the resonator 12 is a completely enclosed structure with driver coupled to the outside of the resonator, it is contemplated in accordance with the principles of the present invention that other gases and other gases at pressures other than one atmosphere will increase the performance of the thermoacoustic refrigerator. For example, better performance is expected in a mixture of Argon and Helium. For a specific mixture of $Ar_{0.36}He_{0.64}$ the thermal conductivity is 0.09 W/m/K, the Prandtl number is 0.351 and the speed of sound at 20° C. is 497 m/s.

As shown in FIG. 1, the resonator 12 has a geometry that is of an atypical geometric shape. Despite its shape, however, the resonator may be a half-wave resonator tuned to 5000 Hz as shown in FIG. 1 or a double half-wave resonator tuned to 5000 Hz (i.e., the half-wave part is tuned to 5000 Hz and the resonator contains one full wave). The thermoacoustic refrigerators of the present invention may have a length of approximately 4 cm to 0.85 cm or smaller with the frequency reaching the ultrasonic range (e.g., 24 kHz or more). Thus, microminiaturization can be achieved by decreasing the size of the resonator with a corresponding increase in sound frequency.

In the present embodiment, the operating frequency is between 4 and 5 kHz with the corresponding wavelength in air at 1 atmosphere from 8 to 6.8 cm. Hence a half-wave resonator at 5,000 Hz would be approximately 3 to 4 cm long. This type of resonator provides the opportunity to make a compact refrigerator. A double half-wave resonator, however, tuned to about 5000 Hz is twice as long as the half-wave resonator since it contains two half-waves of the same wavelength as the half-wave resonator.

Experiments on the half-wave resonator 12 shown in FIG. 1, have indicated that the attained temperature difference ΔT across the stack 22 is a function of the position of the stack in the acoustic standing wave. Thus, ΔT across the stack is a function of the stack's position. At some point, the temperature change due to the pressure change of the sound field is balanced out by the fluid displacement in a temperature gradient and which leads to a critical temperature gradient $\nabla T_{crit}$. It is defined as:

$$\nabla T_{crit} = \frac{\Upsilon - 1}{T_m \beta} \frac{T_m}{\lambda} \tan(x/\lambda)$$

where γ is the ratio of isobaric to isochoric specific heats, $T_m$ is the mean temperature of the fluid, λ is the radian length, β is the thermal expansion coefficient, and x is the stack position relative to the pressure antinode. Experiments have demonstrated that the position of the stack relative to the acoustic standing wave affects the temperature change across the stack, with the spatial dependence normalized to the sound radian wave length.

Once the position of maximum ΔT is established, the stack can be fixed at that position to maximize the efficiency of the thermoacoustic refrigerator. There are a number of ways in which the stack can be adjusted relative to the resonator of the thermoacoustic refrigerator.

A thermoacoustic refrigerator in accordance with the present invention may operate at a sound intensity of at least 156 dB which corresponds to 0.4 W/cm$^2$. For a 3 cm diameter stack, an input acoustic power level is approximately 2.5 watts. At maximum power from the driver it is readily achievable to form a temperature difference ΔT between the hot and the cold end of the stack of 10–30° C. In such a case, the stack is located just before the last pressure antinode away from the driver.

While various embodiments herein illustrate the use of a cone as shown in FIG. 1, it should be noted that depending on the size of the resonator, a cone may not be necessary as the driver itself could provide adequate resonance without an attached cone. Moreover, while the driver has been discussed herein as comprising a piezoelectric driver, the driver may comprise any type of high frequency sound generating device whether currently known in the art or later developed.

Figure 6:
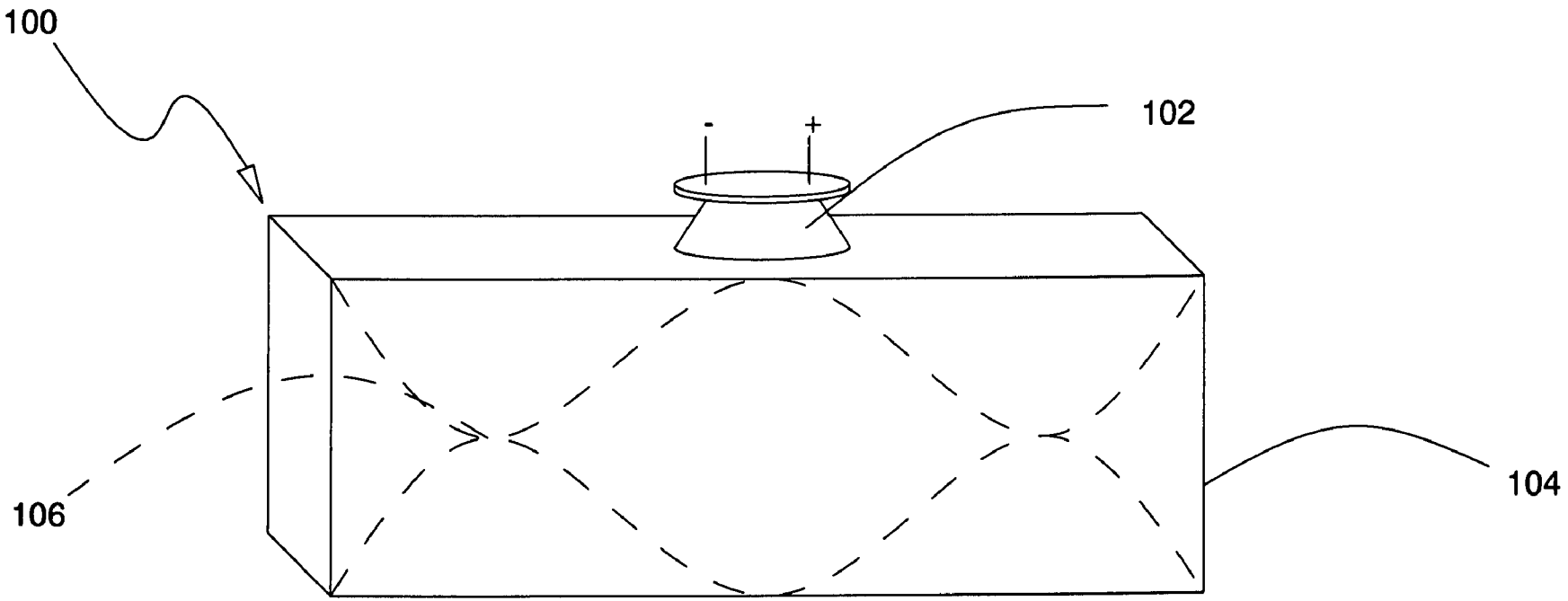
FIG. 6 is a cross-sectional side view of a second embodiment of a compact thermoacoustic refrigerator in accordance with the principles of the present invention.

FIG. 6 illustrates a rectangular or cube-like shaped thermoacoustic refrigerator, generally indicated at 100, in accordance with the principles of the present invention. A driver 102 is located in the top of the resonator 104 to produce a standing wave 106 within the resonator 104. As with the other embodiments provided herein, stack/heat exchanger arrangements can then be placed within the resonator 104 at desired locations depending on the location of stack/heat exchanger that achieves the best cooling performance relative to the standing wave 106. By placing the driver 102 on the outside of the resonator 104, the driver 102 does not interfere with the acoustics produced within the resonator 104 and therefore does not alter or effect the inside shape of the resonator. Thus, the position of the standing wave 106 is much more easy to predict in order to determine the optimal position for the stack in relation to the resonator 104. In addition, heat dissipated in the driver is radiated outside of the resonator 104 and therefore is not directly transferred to the resonator 104. As such, refrigeration or cooling efficiency of the device is improved.

Figure 7:
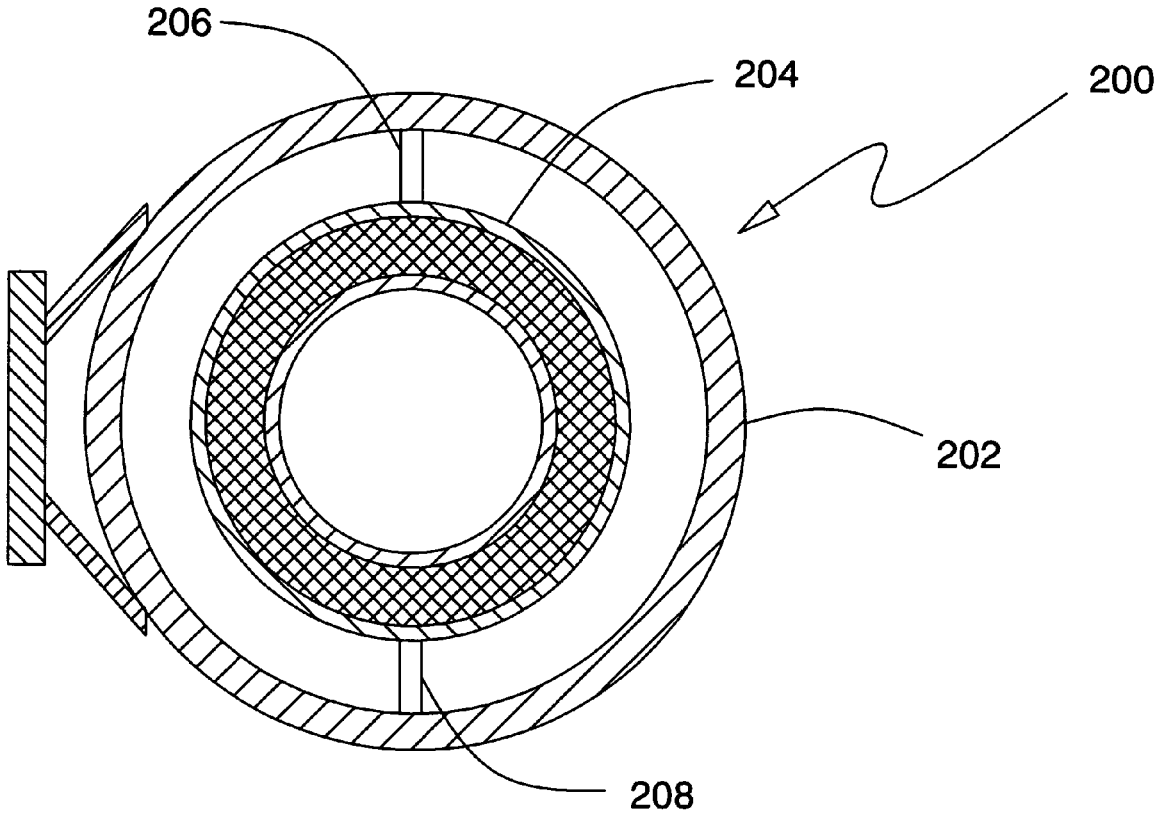
FIG. 7 is a cross-sectional side view of a third embodiment of a compact thermoacoustic refrigerator in accordance with the principles of the present invention.
Figure 10:
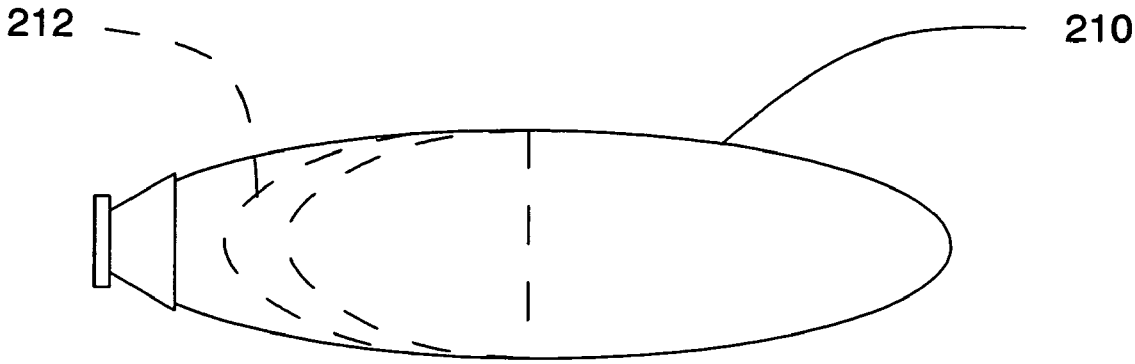
FIG. 10 is a side view of a sixth embodiment of a compact thermoacoustic refrigerator in accordance with the principles of the present invention.
Figure 11:
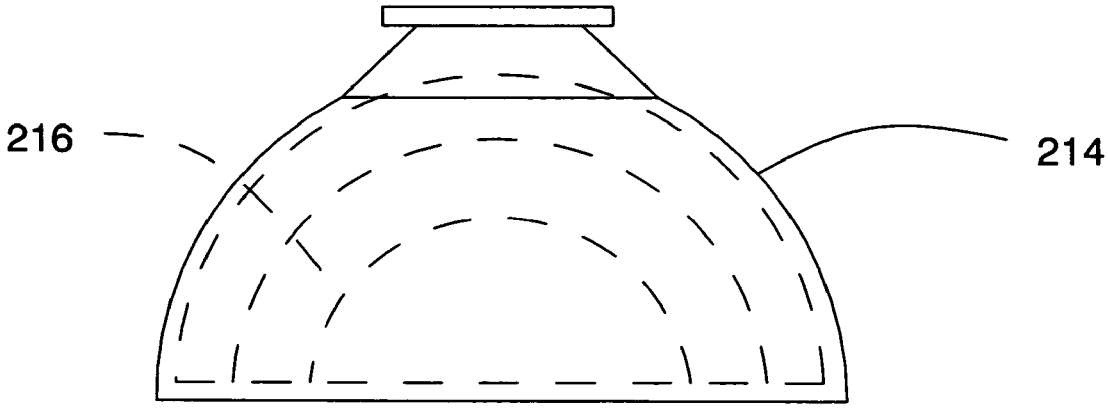
FIG. 11 is a side view of a seventh embodiment of a compact thermoacoustic refrigerator in accordance with the principles of the present invention.

As shown in FIG. 7, a thermoacoustic refrigerator, generally indicated at 200, is comprised of a spherically-shaped resonator 202 within which is positioned a spherically-shaped stack 204. The stack 204 is supported within the resonator 202 with support members 206 and 208. Because the standing wave within such a spherical resonator 202 is generally spherical in nature itself, a spherical stack 204 can be positioned to maximize the cooling power produced by the standing wave in all radial directions relative to the center of the resonator 202. Likewise, a dome-shape resonator 214 (i.e., a semi-spherical resonator) as shown in FIG. 11 and similarly configured dome-shaped stack 216 could produce similar cooling efficiencies. Thus, while it has been discussed herein that an asymmetrical resonator has certain benefits with relation to cooling power, it is also the case that a round-shaped resonator 210 (see FIG. 10) with similarly configured round-shaped stack 212 also increases cooling power for a given sized resonator operating at a particular frequency. Because the standing wave has a generally spherical shape as well, the stack 212 more closely matches the shape of the standing wave and is positioned relative to the standing wave to produce maximum cooling over a larger surface area of the stack 212.

Figure 8:
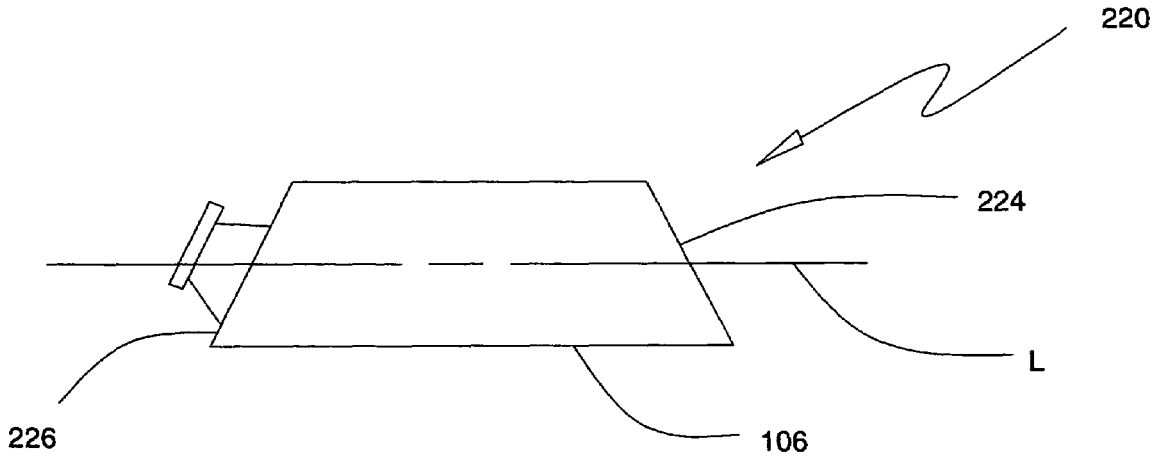
FIG. 8 is a side view of a fourth embodiment of a compact thermoacoustic refrigerator in accordance with the principles of the present invention.

It is contemplated with respect to the present invention, that various resonator configurations could be devised upon an understanding of the principles of the present invention. Thus, while the following exemplary resonator configurations are illustrated, there may be other configurations of equal utility, and the present invention and the appended claims hereto are intended to cover any such other configurations. For example, as shown in FIG. 8, a thermoacoustic refrigerator 220 is provided having a cylindrically-shaped resonator 222. The ends 224 and 226, however, of the resonator 222 are angled relative to the longitudinal axis L of the resonator. As such, when divided in cross-section along the longitudinal axis L of the resonator 222, the resonator 222 is asymmetrical in shape. This asymmetry dissipates higher modes of acoustic resonance while maximizing the primary mode.

Figure 9:
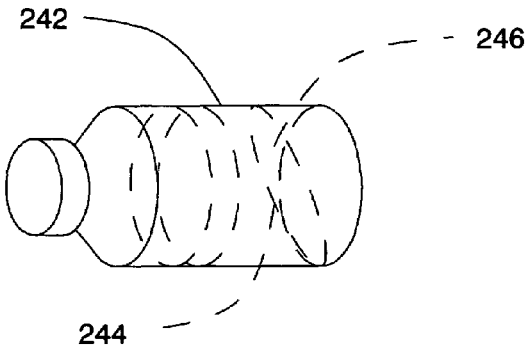
FIG. 9 is a perspective side view of a fifth embodiment of a compact thermoacoustic refrigerator in accordance with the principles of the present invention.

As illustrated in FIG. 9, the external shape of the resonator 242 may not necessarily match the internal shape of the resonator's chamber 244. Thus, the asymmetry of the chamber 244 may be defined by one or more angled surfaces 246 within the resonator 242.

Figure 12:
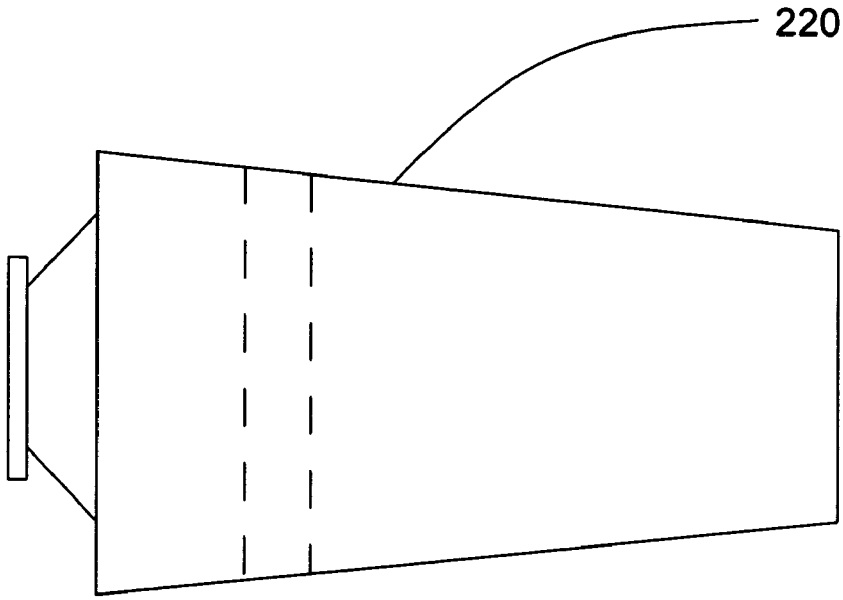
FIG. 12 is a side view of a eighth embodiment of a compact thermoacoustic refrigerator in accordance with the principles of the present invention.
Figure 13:
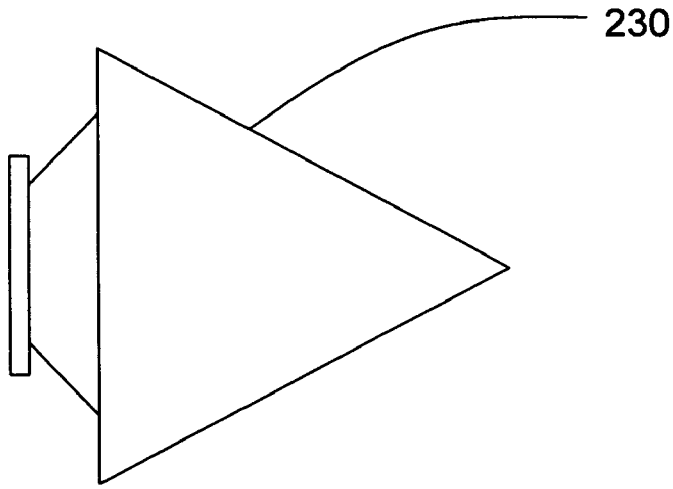
FIG. 13 is a side view of a ninth embodiment of a compact thermoacoustic refrigerator in accordance with the principles of the present invention.

As shown in FIG. 12, a frustoconically-shaped resonator 220 would provide an asymmetrically-shaped internal chamber when viewed as shown in FIG. 12. Likewise, a conically-shaped resonator 230 would also provide such asymmetry so as to maximize the primary resonance mode while dissipating other non-primary modes of resonance.

In order to enhance the performance of such a thermoacoustic refrigerator, the small size of such a device allows the refrigerator to be pressurized to a higher pressure than other devices known in the art. Also, the working fluid may be changed from air to some other gas or combination of gases. Since a limiting factor is the viscous boundary layer characterized by a viscous penetration depth $\delta_v$. It is appropriate to choose a fluid with a low Prandtl number such as a mixture of 64% He and 36% Ar whose Prandtl number is 0.3507 and where the speed of sound is 497 m/sec. Compared to air this required a scaling factor of 1.4 in size to keep the resonance at the same frequency as for air.

The improved performance which can be achieved when the fluid is at higher pressures is due to scaling similitude principles and to the superior impedance matching between the driver and the fluid. Working at high pressure is an advantage with the present invention since a small refrigerator is structurally strong enough to withstand very high pressures.

The maximum temperature difference that can be produced across a stack results from a competition between the temperature change due to an adiabatic pressure change of the working fluid and its displacement along the stack which has a temperature gradient. When the temperature rise due to an adiabatic compression is greater than the temperature rise due to the displacement along a temperature gradient of the stack, the engine works as a heat pump or refrigerator. Conversely, the engine works as a prime mover. The critical gradient $\nabla T_{crit}$ given above separates the two regimes. This fundamental limitation is overcome by the present invention. First, the use of two stacks and corresponding heat exchangers inside a double ½ wave resonator allows the ΔT of each to be cascaded. This is particularly important for the ultrasonic regime where the wavelength is short and hence the stack used will also be short. Second, the stack length Δx can be increased by using a fluid where the speed of sound is higher than in air.

The gradual transport of heat along the stack during refrigeration operation ends when the symmetry is broken at each end and hence a heat exchanger is needed at each end to dispose of the heat or absorb it. At the cold end the interface has to transfer heat $Q_c$ while at the hot end the heat transferred there is $Q_c$+W, where W is the work done on the system by sound. Since at the interface of stack-heat exchanger heat is transferred by thermal contact of the cotton wool fibers to the heat exchangers, the contact thermal resistance can limit the flow of heat. This is reduced by the shuffling action of the sound field which moves the heat in small steps along the stack and across small enough gaps between the heat exchangers and the stack.

A contact thermal resistance $R_{co}$ can be defined as:

$$R_{co}=1/h_{co}A_e$$

where $h_{co}=1.25\ k_s\ (m/\sigma)\ (P/H)$ with $k_s$ being a harmonic mean thermal conductivity for the 2 solids in contact, σ is a measure of surface roughness of the 2 solids, m is related to angles of contact, P is the contact pressure and H is the microhardness of the softer solid. For a transistor casing and a nylon washer this resistance is 2° C./W while for transistor in contact with air it is 5° C./W. For cotton wool to heat exchanger interface, the thermal resistance is estimated to be $R_{co}$=3.5–7° C./W. For a total heat flow of 2 watts the interfaces can easily develop a AΔT of 7–15° C. Moreover, closer examination of a random stack shows that it is formed from several layers of cotton wool pressed together with a large fraction of fibers aligned perpendicular to the axis of heat transport. A more random distribution of fibers and preferably a longitudinal alignment of fibers along the axis of the heat transport would give improved performance.

An important function of the stack is the storage and rectification of heat flow as it is being shuffled from one end of the stack to the other. This requires a large surface area; cotton wool is exceptionally well-suited for this task. A cotton wool stack offers an enormous surface area (e.g., around 150 $cm^2$). It occupies 1–5% of the stack volume, and more optimally between 1 and 2 percent, with the rest being air. The thickness of such a stack should be calculated to accommodate for the thermal penetration depth around each fiber. For short stacks, a random fiber approach provides improved performance by providing a larger interaction with the sound field as compared to the prior art Mylar sheets and leads to simplicity in the construction of the stack.

The use of multiple stacks as herein described, overcomes many of the limitations of the prior art. For example, by cascading stacks in series thermally, improved efficiency can be achieved with the possibility of opening the way for very low temperature refrigeration using thermoacoustics. In addition, operation at high frequencies requires all the dimensions, including the stack, to be reduced. Utilizing multiple stacks, however, in cascade overcomes the problem of the small thickness of each stack thus making it possible to go to the ultrasonic range.

When operating a thermoacoustic refrigerator in accordance with the present invention at high frequencies, the cone may not be necessary when the pressure of the working fluid is raised since the impedance match between the driver and working fluid will be improved. As such, another advantage of high frequency operation and thus a smaller device is that very high fluid pressure can be used before limitations of strength of materials come into effect since the surface area of such a device is quite small. In addition, an important consideration for high frequency operation of this refrigerator is that large critical gradients $\nabla T_{crit}$ can be attained. Since this parameter is essentially $T_1/x_1$, the temperature change $T_1$ due to the acoustic pressure variation $P_1$ and the displacement $x_1$ in the sound wave leads to a large temperature change $T_1$ with small displacement $x_1$ since $x_1=u_1/\omega$ (where $u_1$ is the particle speed in the sound field). Compression and expansion in a sound field causes a gas temperature oscillation which leads to a temperature difference between the gas and the stack. Such temperature difference causes a heat flow from gas to stack on the high pressure part of the cycle. On the other hand, a temperature gradient along the stack causes a reverse heat flow from stack to gas when the stack is hotter than the gas. In essence, heat is pumped from cold to hot when the acoustically produced gradient is less than the critical temperature gradient across the stack. This shows how a small $x_1$ and large $P_1$ can lead to a large temperature difference across the stack and hence to a low minimal temperature.

High frequency operation also favors a high power density. The energy flux per unit volume is proportional to the pump frequency. Power densities of approximately 10 $W/cm^3$ can be achieved at about 5,000 Hz at relatively high sound levels.

Finally, high frequency operation for a resonant system leads to small total volume for the refrigerator. This is particularly useful for applications where compactness and rapid cool-down are important factors.

It will be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

What is claimed is:

1. A thermoacoustic refrigerator, comprising:

a resonator having an outer surface and defining an interior chamber having a length approximately equal to an effective diameter, said interior chamber having an asymmetrical configuration;

a high frequency driver coupled to said outer surface of said resonator for generating a standing wave within said chamber;

a stack disposed within said resonator, said stack defining a first side and a second side; and first and second heat exchangers, said first heat exchanger abutting said first side of said stack and said second heat exchanger abutting said second side of said stack.

2. The thermoacoustic refrigerator of claim 1, wherein said asymmetrical configuration comprises one of a an ovoid, a frustoconical shape, a trapezoidal shape, a dome shape, and a cylindrical shape with angled ends.

3. The thermoacoustic refrigerator of claim 1, wherein said stack and said first and second heat exchangers define a semi-spherical stack assembly.

4. The thermoacoustic refrigerator of claim 1, wherein said stack assembly has a shape to coincide with a shape of the standing wave within said resonator.

5. The thermoacoustic refrigerator of claim 1, wherein said stack is comprised of random fibers.

6. The thermoacoustic refrigerator of claim 5, wherein said random fibers are comprised of at least one of cotton wool and glass wool.

7. The thermoacoustic refrigerator of claim 1, wherein said stack has a thickness of approximately 0.1 of the length of said chamber.

8. The thermoacoustic refrigerator of claim 1, wherein said stack has a volume filling factor of approximately one to five percent.

9. The thermoacoustic refrigerator of claim 1, wherein said first and second heat exchangers have a spacing of approximately ten percent of half the wavelength of the standing wave.

10. The thermoacoustic refrigerator of claim 1, wherein said stack has a thickness of approximately ten percent of a length of said chamber.

11. The thermoacoustic refrigerator of claim 1, further comprising a working fluid disposed within said resonator selected from at least one of air, an inert gas and mixtures of inert gases.

12. The thermoacoustic refrigerator of claim 1, wherein said first high frequency driver is comprised of a piezoelectric driver for producing sound at a frequency above 4,000 Hz.

13. A thermoacoustic refrigerator, comprising:

a resonator having an outer surface and defining an interior chamber having a length not greater than one wavelength of a standing wave to be generated therein, said interior chamber having a non-cylindrical, rounded configuration;

a high frequency driver coupled to said outer surface of said resonator for generating a standing wave within said chamber;

a stack disposed within said resonator, said stack defining a first side and a second side; and first and second heat exchangers, said first heat exchanger abutting said first side of said stack and said second heat exchanger abutting said second side of said stack.

14. The thermoacoustic refrigerator of claim 13, wherein said rounded configuration comprises one of a sphere, an ovoid, an elliptical shape, a frustoconical shape, and a conical shape.

15. The thermoacoustic refrigerator of claim 13, wherein said stack and said first and second heat exchangers define an at least partial spherical stack assembly.

16. The thermoacoustic refrigerator of claim 15, wherein said stack assembly has a shape to coincide with a shape of the standing wave within said resonator.

17. The thermoacoustic refrigerator of claim 15, wherein said stack assembly has a shape to coincide with a shape of said chamber.

18. The thermoacoustic refrigerator of claim 13, wherein said stack is comprised of random fibers.

19. The thermoacoustic refrigerator of claim 18, wherein said random fibers are comprised of at least one of cotton wool and glass wool.

20. The thermoacoustic refrigerator of claim 13, wherein said stack has a thickness of approximately 0.1 of the length of said chamber.

21. The thermoacoustic refrigerator of claim 13, wherein said stack has a volume filling factor of approximately one to five percent.

22. The thermoacoustic refrigerator of claim 13, wherein said first and second heat exchangers have a spacing of approximately ten percent of half the wavelength of the standing wave.

23. The thermoacoustic refrigerator of claim 13, wherein said stack has a thickness of approximately ten percent of a length of said chamber.

24. The thermoacoustic refrigerator of claim 13, further comprising a working fluid disposed within said resonator selected from at least one of air, an inert gas and mixtures of inert gases.

25. The thermoacoustic refrigerator of claim 13, wherein said first high frequency driver is comprised of a piezoelectric driver for producing sound at a frequency above 4,000 Hz.

26. A thermoacoustic refrigerator, comprising:

a resonator having an outer surface and defining an interior chamber having a length not greater than a wavelength of a standing wave to be generated within said resonator;

a high frequency driver coupled to said outer surface of said resonator for generating the standing wave within said chamber;

a stack disposed within said resonator, said stack defining a first side and a second side; and first and second heat exchangers, said first heat exchanger abutting said first side of said stack and said second heat exchanger abutting said second side of said stack.

27. The thermoacoustic refrigerator of claim 26, wherein said interior chamber has a non-cylindrical, rounded configuration.

28. The thermoacoustic refrigerator of claim 26, wherein said interior chamber has an asymmetrical configuration comprises one of a an ovoid, a frustoconical shape, a trapezoidal shape, a dome shape, and a cylindrical shape with angled ends.

29. The thermoacoustic refrigerator of claim 27, wherein said rounded configuration comprises one of a sphere, an ovoid, an elliptical shape, a frustoconical shape, and a conical shape.

30. The thermoacoustic refrigerator of claim 28, wherein said stack and said first and second heat exchangers define an at least partially spherical stack assembly.

31. The thermoacoustic refrigerator of claim 28, wherein said stack assembly has a shape to coincide with a shape of the standing wave within said resonator.

32. The thermoacoustic refrigerator of claim 26, wherein said stack assembly has a shape to coincide with a shape of said chamber.

33. The thermoacoustic refrigerator of claim 26, wherein said stack is comprised of random fibers.

34. The thermoacoustic refrigerator of claim 33, wherein said random fibers are comprised of at least one of cotton wool and glass wool.

* * * * *